United States Patent [19]

Miller

[11] Patent Number: 4,566,822

[45] Date of Patent: Jan. 28, 1986

[54] CONSTRUCTION MACHINE

[75] Inventor: Charles P. Miller, McHenry, Ill.

[73] Assignee: Miller Formless Co., Inc., McHenry, Ill.

[21] Appl. No.: 580,290

[22] Filed: Feb. 21, 1984

Related U.S. Application Data

[63] Continuation of Ser. No. 305,204, Sep. 24, 1981, abandoned.

[51] Int. Cl.[4] ..... E01C 19/18

[52] U.S. Cl. ..... 404/84; 404/100; 404/105

[58] Field of Search ..... 404/105, 108, 98, 96, 404/84, 101, 100; 405/268

[56] References Cited

U.S. PATENT DOCUMENTS

| | | | |
|---|---|---|---|
| 2,094,974 | 10/1937 | Wood | 404/96 X |
| 2,176,891 | 10/1939 | Crom | 405/268 X |
| 2,303,486 | 12/1942 | McConnaughay | 404/105 |
| 2,827,771 | 3/1958 | Baer | 405/268 |
| 2,864,452 | 12/1958 | Guntert | 404/84 |
| 2,975,602 | 3/1961 | Stromberg | 405/268 |
| 3,171,260 | 3/1965 | Hanson | 405/268 |
| 3,247,771 | 4/1966 | Hanson | 405/268 X |
| 3,247,922 | 4/1966 | Hanson | 180/9.52 |
| 3,249,026 | 5/1966 | Curlett | 404/84 |
| 3,257,917 | 6/1966 | Lewis | 404/105 |
| 3,267,824 | 8/1966 | Hudis | 404/100 |
| 3,328,902 | 7/1967 | Hanson | 404/96 X |
| 3,749,505 | 7/1973 | Miller | 404/98 |
| 3,849,016 | 11/1974 | Cochrane et al. | 404/100 |
| 3,936,211 | 2/1976 | Miller | 404/96 X |
| 4,029,165 | 6/1977 | Miller | 404/98 X |
| 4,432,672 | 2/1984 | Brüderle et al. | 405/268 |

FOREIGN PATENT DOCUMENTS

| | | | |
|---|---|---|---|
| 2840800 | 6/1979 | Fed. Rep. of Germany | 405/268 |

*Primary Examiner*—Stephen J. Novosad

*Attorney, Agent, or Firm*—Neuman, Williams, Anderson & Olson

[57] ABSTRACT

A construction machine is provided for use in the controlled distribution of formable concrete along a base surface of predetermined configuration. The machine includes a self-propelled main frame movable along the base surface. The main frame is provided with a front section and an elongated trailing section extending rearwardly therefrom. A first hopper is mounted forwardly of the frame front section for receiving a load of formable concrete. An elongated mule is mounted transversely on the frame trailing section. The mule is spaced a substantial distance rearwardly of the frame front section and includes an elongated second hopper having the underside thereof conforming substantially to the predetermined configuration of the base surface. A conveying means is carried on the main frame and effects controlled transfer of the formable concrete from the first hopper to opposite end portions of the second hopper. Vibrating means is carried on the mule. Control means is mounted on the main frame for controlling relative moving and steering of the machine along a prescribed path on the base surface.

21 Claims, 14 Drawing Figures

CONSTRUCTION MACHINE

This application is a continuation of application Ser. No. 305,204 filed Sept. 14, 1981 now abandoned.

BACKGROUND OF THE INVENTION

The use of the slip-form concept in construction machines for laying roads, curbs, etc. has been well known for many years. Such machines, however, are beset with one or more of the following shortcomings: (a) they are normally side loaded from trucks which travel along a path disposed to one side of and parallel with the base surface on which the concrete is to be laid and not from trucks moving ahead of the machine along the base surface over which the machine also subsequently passes; (b) they are difficult to maneuver along a prescribed path on the base surface; (c) because of the machine design, it is difficult and awkward to lay reinforcing mesh or rods ahead of the mule; (d) the machines were incapable of readily laying concrete where the contour of the base surface was of a semi-circular or concave configuration; (e) the machines are incapable of being used in tunnel construction or the like; (f) the machines are costly to maintain and service; (g) they require an inordinate number of operating personnel; and (h) the maximum width of the concrete to be laid at one time by the machine was substantially limited to the transverse spacing between the tracks of the machine.

SUMMARY OF THE INVENTION

Thus, it is an object of the invention to provide a construction machine of the type described which avoids all of the aforenoted shortcomings.

It is a further object of the invention to provide a construction machine of the type described wherein the tracks mounted on the main frame for propelling same along the base surface are independently adjustable so as to substantially conform to the configuration of the portion of the base surface engaged thereby.

It is a still further object to provide a construction machine of the type described wherein the trailing section of the frame is cantilevered rearwardly from the frame front section.

It is a still further object to provide a construction machine wherein the machine, while moving along the base surface, is loaded at the front of the main frame from trucks preceding the machine along the base surface on which the concrete is to be laid by the machine.

It is a still further object to provide a construction machine wherein the underside of the rear hopper, forming a part of the mule, is shaped so as to substantially conform to the predetermined configuration of the base surface engaged by the mule.

It is a still further object to provide a construction machine wherein reinforcing mesh or rods may be readily laid on the base surface ahead of the mule, and out of the way of the tracks of the machine.

It is a still further object to provide a construction machine wherein the mule may have a lateral dimension which is substantially greater than the lateral spacing between the tracks of the machine.

Further and additional objects will appear from the description, accompanying drawings, and appended claims.

In accordance with one embodiment of the invention a construction machine is provided for the controlled distribution of formable concrete on a base surface of predetermined configuration. The machine is provided with a self-propelled main frame which has a front section and an elongated trailing section cantilevered rearwardly therefrom a substantial distance. Mounted forwardly of the frame front section is an elongated transversely extending first hopper for receiving a load of formable concrete from a supply truck preceding in front of the machine along the base surface. Mounted on the frame trailing section and extending substantially transversely therefrom is an elongated mule. The mule is spaced a substantial distance rearwardly of the frame front section and includes an elongated second hopper extending substantially transversely of the direction the frame moves along the base surface. The underside of the second hopper has a configuration which conforms substantially to the predetermined configuration of the base surface. The mule also includes vibrating means and adjustable means disposed within the second hopper to control gravitational flow of the formable concrete within the second hopper. Mounted on the main frame is a conveying means which effects controlled transfer of the formable concrete from the first hopper to opposite end portions of the second hopper. Control means are provided on the main frame for controlling the relative movement and steering of the machine along the base surface in a prescribed path.

DESCRIPTION

For a more complete understanding of the invention reference should be made to the drawings wherein.

Figure 1:
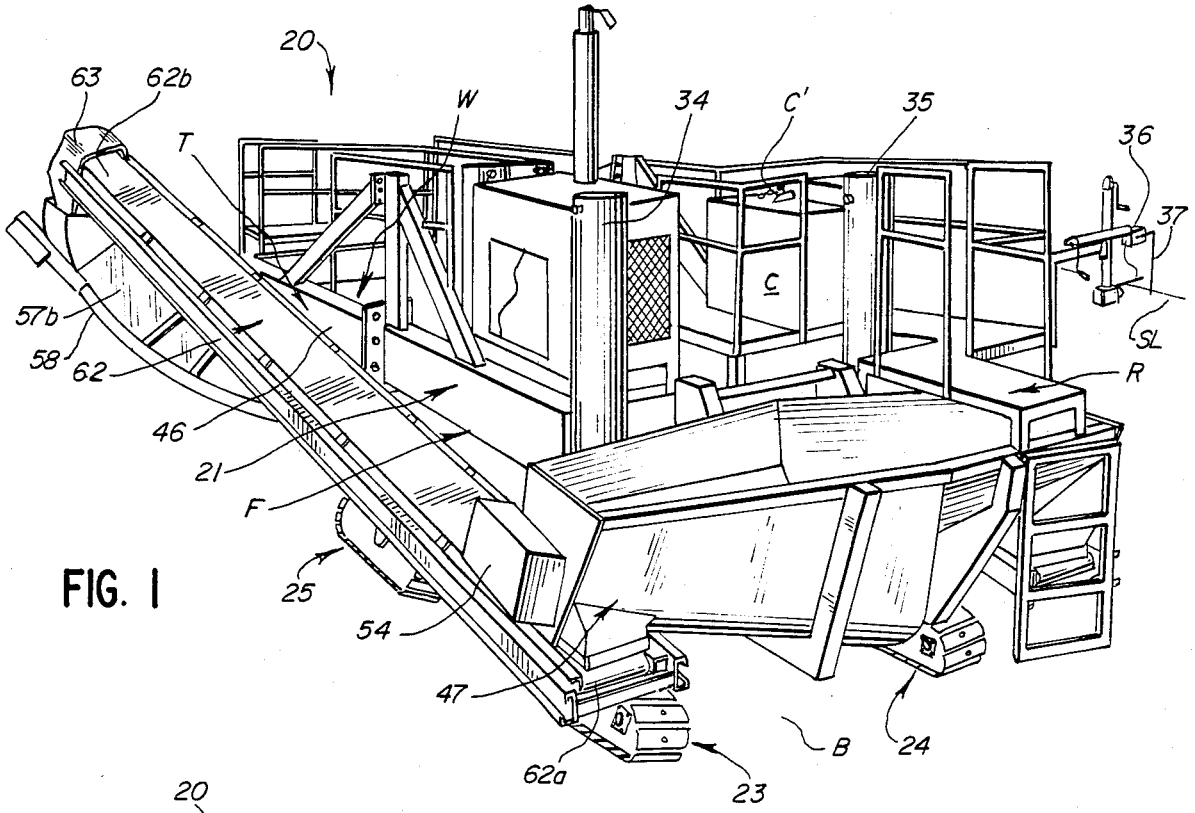
FIG. 1 is a fragmentary front perspective view of one embodiment of the improved construction machine.
Figure 2:
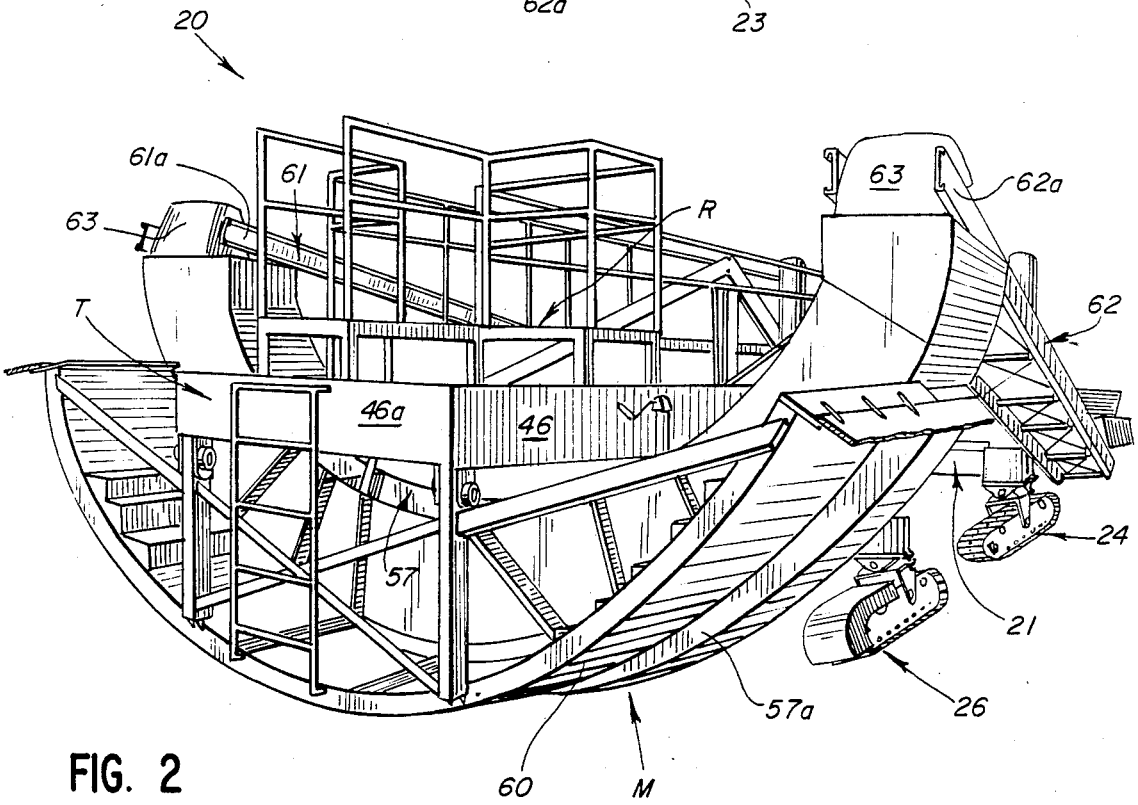
FIG. 2 is a fragmentary rear perspective view of the machine shown in FIG. 1.
Figure 3:
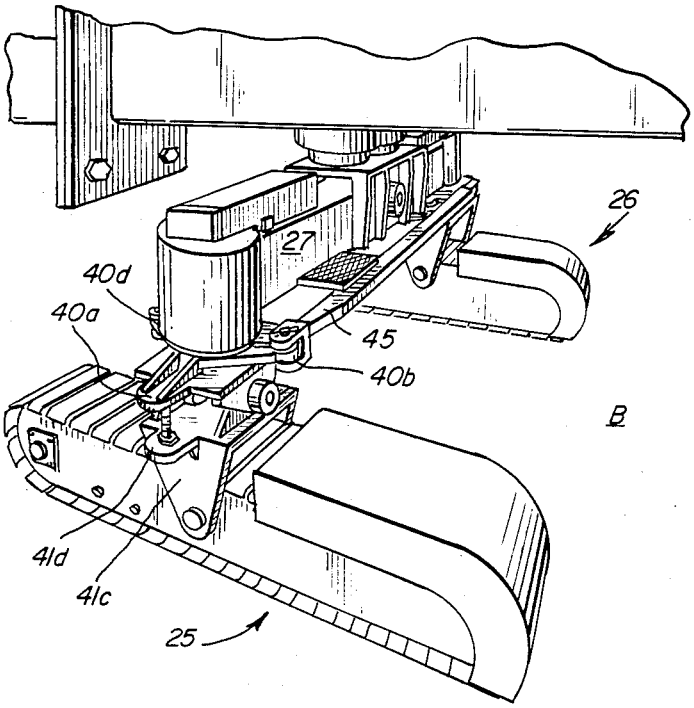
FIG. 3 is an enlarged fragmentary side perspective view of the rear set of the self-propelling tracks mounted on the underside of the machine main frame.
Figure 7:
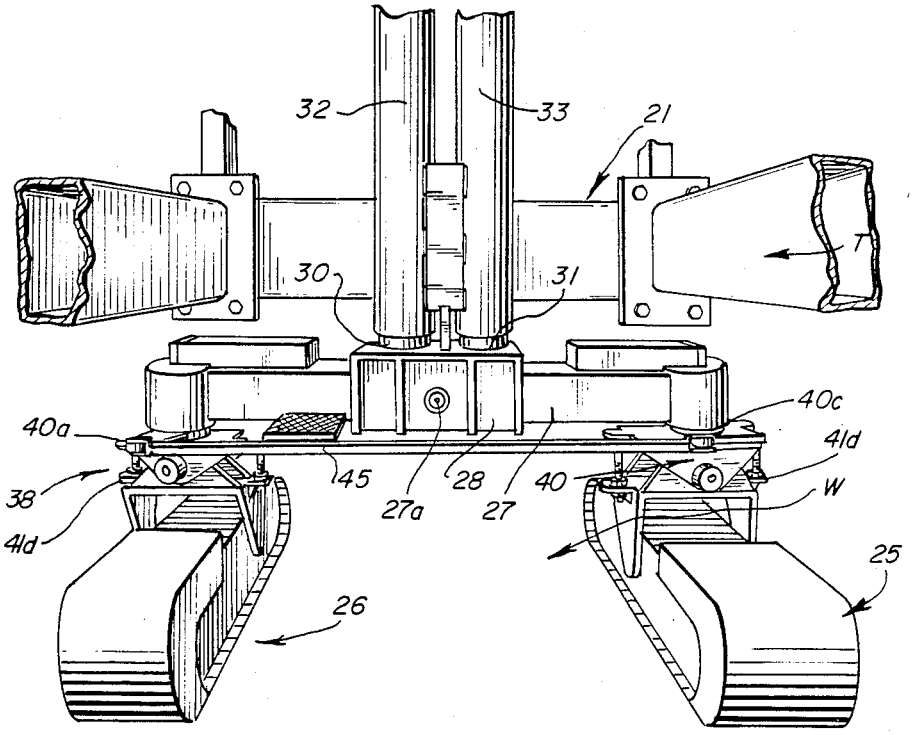
FIG. 7 is a fragmentary rear perspective view of the rear set of tracks mounted on the underside of the machine main frame.

Referring now to the drawing and, more particularly, to FIGS. 1 and 2, one form of the improved construction machine 20 is shown which includes a main frame 21 having mounted on and depending from the underside 22 thereof a plurality of self-propelling tracks 23, 24, 25, and 26. Tracks 23, 24 are spaced laterally from one another a substantial distance and are disposed forwardly of tracks 25, 26, the latter being interconnected to one another by an elongated beam 27, see FIGS. 3 and 7. The beam is pivotally connected at its midpoint 27*a* to an inverted substantially channel-like bracket 28. Extending upwardly from the top of the bracket is a pair of elongated pistons 30, 31 which terminate within suitable upright cylinders 32, 33, the latter being fixedly secured to the backside of the main frame 21. Suitable hydraulic fittings and connections, not shown, are provided on the cylinders 32, 33 to effect varied elevations of the main frame relative to the base surface B along which the machine 20 is self-propelled. Similar piston-cylinder assemblies 34, 35 are provided for the front tracks 23, 24, see FIG. 12.

Each of the tracks 23–26 is driven by a suitable hydraulic motor. The speeds of the motors are normally synchronized for straight-line movement of the machine along the base surface, in a manner well-understood in the art. When the machine 20 is to move in other than a straight-line direction the tracks are turned individually about the longitudinal centerlines of the pistons as the turning axes. The prescribed path the machine is to travel along the base surface B is determined by a conventional taut stringline SL (FIG. 1) carefully positioned along the base surface. While a taut stringline is normally utilized to define the prescribed path, other elongated guiding elements may be utilized for this purpose. The stringline is normally held in place by a plurality of relatively spaced stakes or poles, which project outwardly or upwardly from the base surface B, or from an area adjacent the base surface.

Where a tunnel construction is involved, as will be discussed more fully hereinafter, such stakes are placed at a predetermined elevation above the bottom of the tunnel. Suitable sensors 36, 37 are mounted on and project laterally from the main frame 21 and gently slide along the top and side, respectively, of the stringline so as to sense any change in direction, either vertically or horizontally, of the stringline. Such change will be relayed to a suitable control mechanism C carried on the main frame and then to the steering mechanism. The utilization of stringlines and sensors for this purpose is well known in the art.

Figure 4:
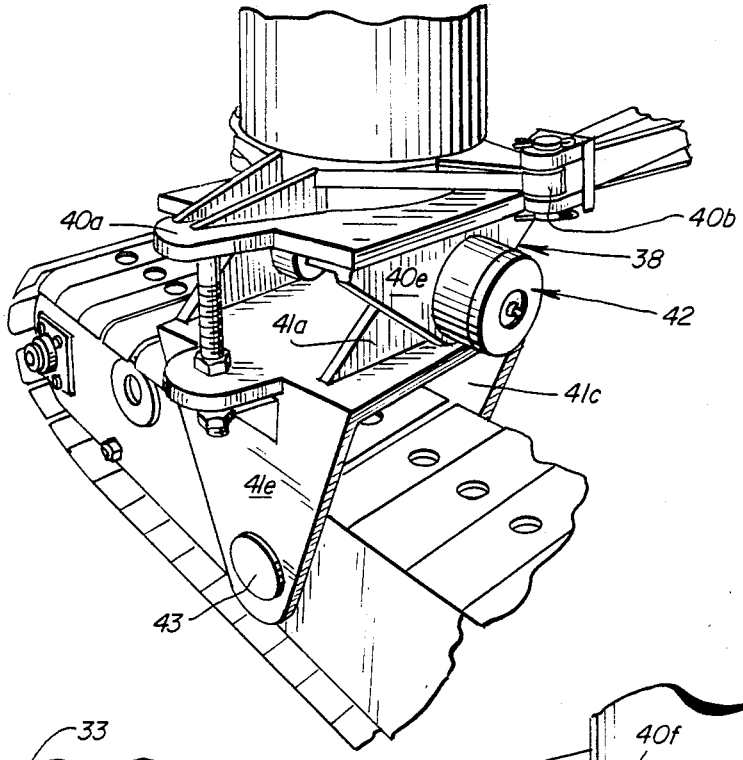
FIG. 4 is an enlarged fragmentary rear perspective view of one of the tracks of FIG. 3.
Figure 13:
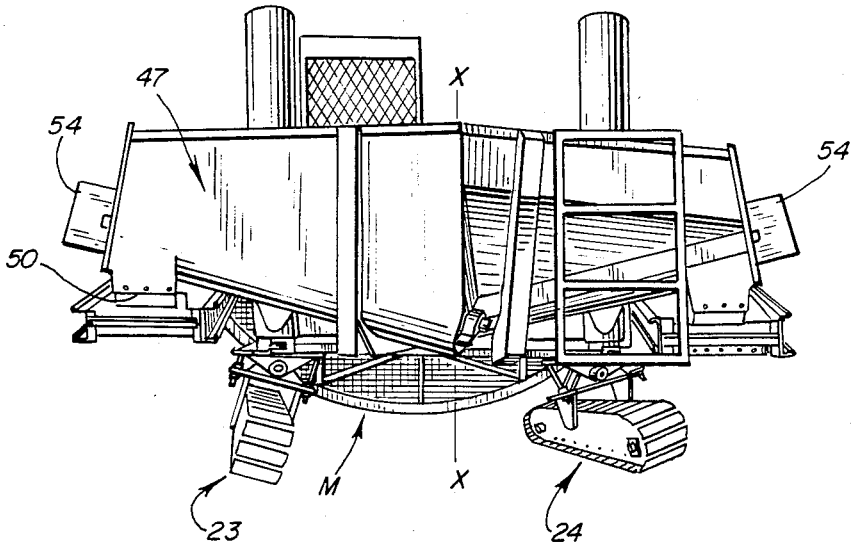
FIG. 13 is an enlarged fragmentary front perspective view of the first hopper.
Figure 14:
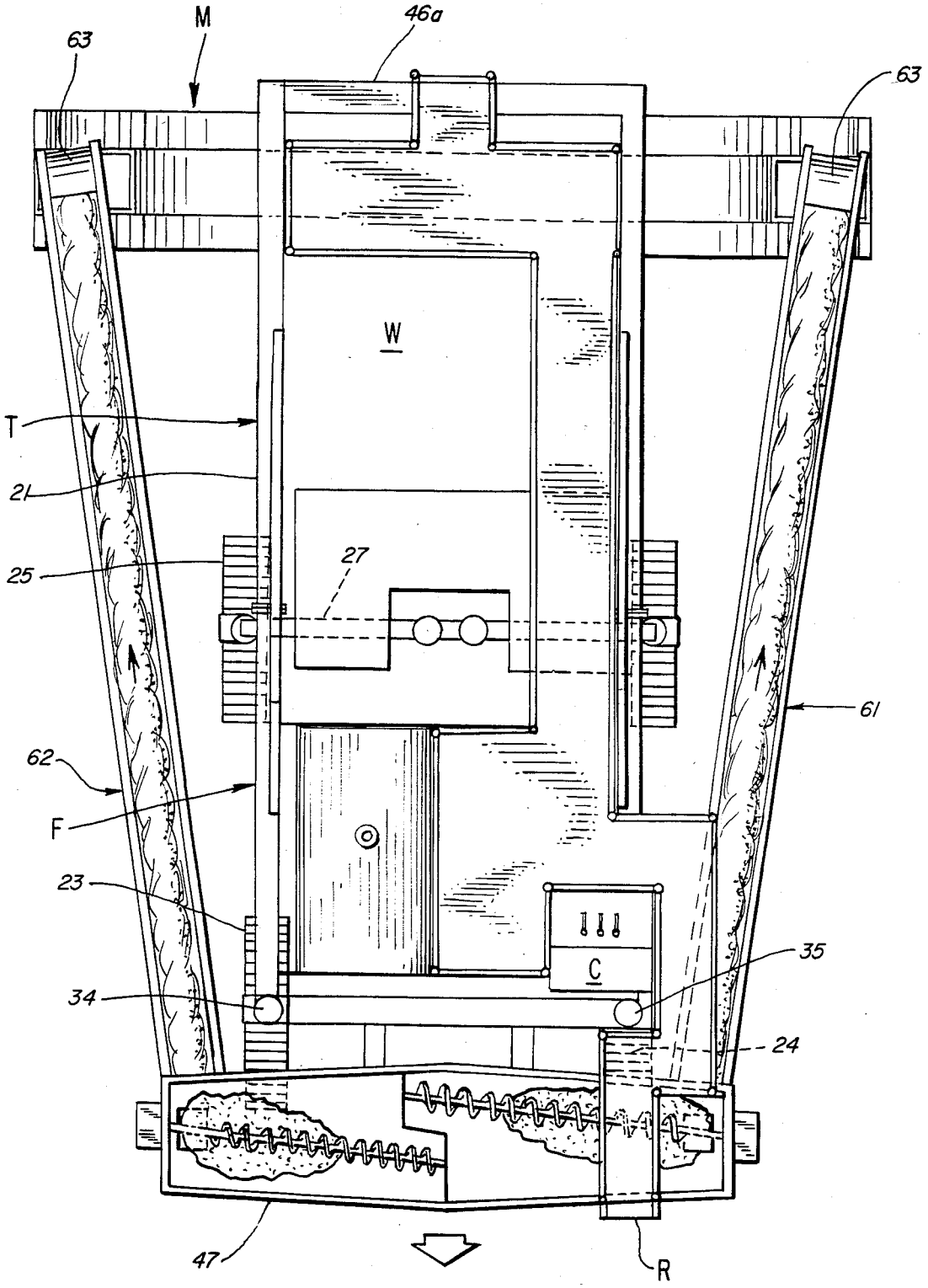
FIG. 14 is a top plan view of the machine shown in FIG. 1.

As noted in FIGS. 1 and 13, the tracks 23, 24 as well as tracks 25, 26, are adapted to assume tilted positions so as to conform substantially to the configuration of base surface B. Such adjustability of the individual tracks is accomplished by reason of a saddle assembly 38, as seen more clearly in FIGS. 4 and 6, which is associated with each track. Assembly 38 includes an upper section 40 which is fixedly attached to the exposed lower end of the piston forming a component of piston-cylinder assembly 34, 35 or the lower end of a cylindrical post, not shown, which is journalled at an end of beam 27. Projecting laterally from upper section 40 are a plurality of circumferentially spaced lugs 40*a*, 40*b*, 40*c*, 40*d*. The function of these lugs will be discussed more fully hereinafter. Lug 40*a* is reinforced by a pair of stiffening ribs.

Figure 6:
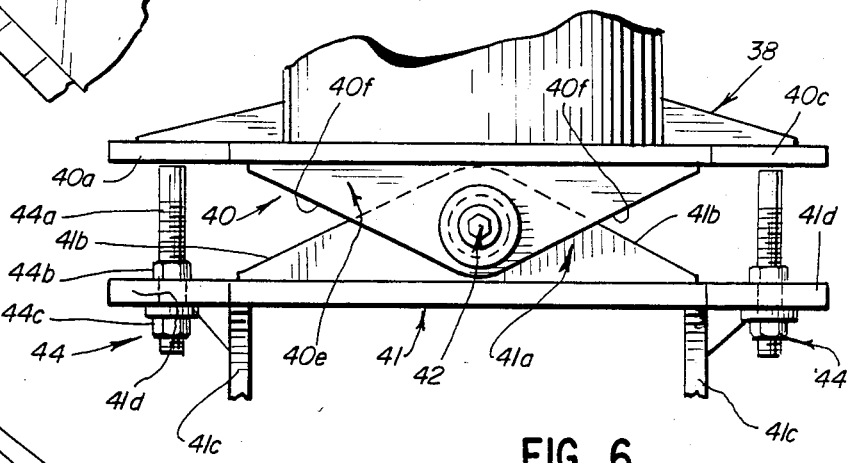
FIG. 6 is an enlarged fragmentary side elevational view of a saddle assembly forming a component of the track of FIG. 4.
Figure 5:
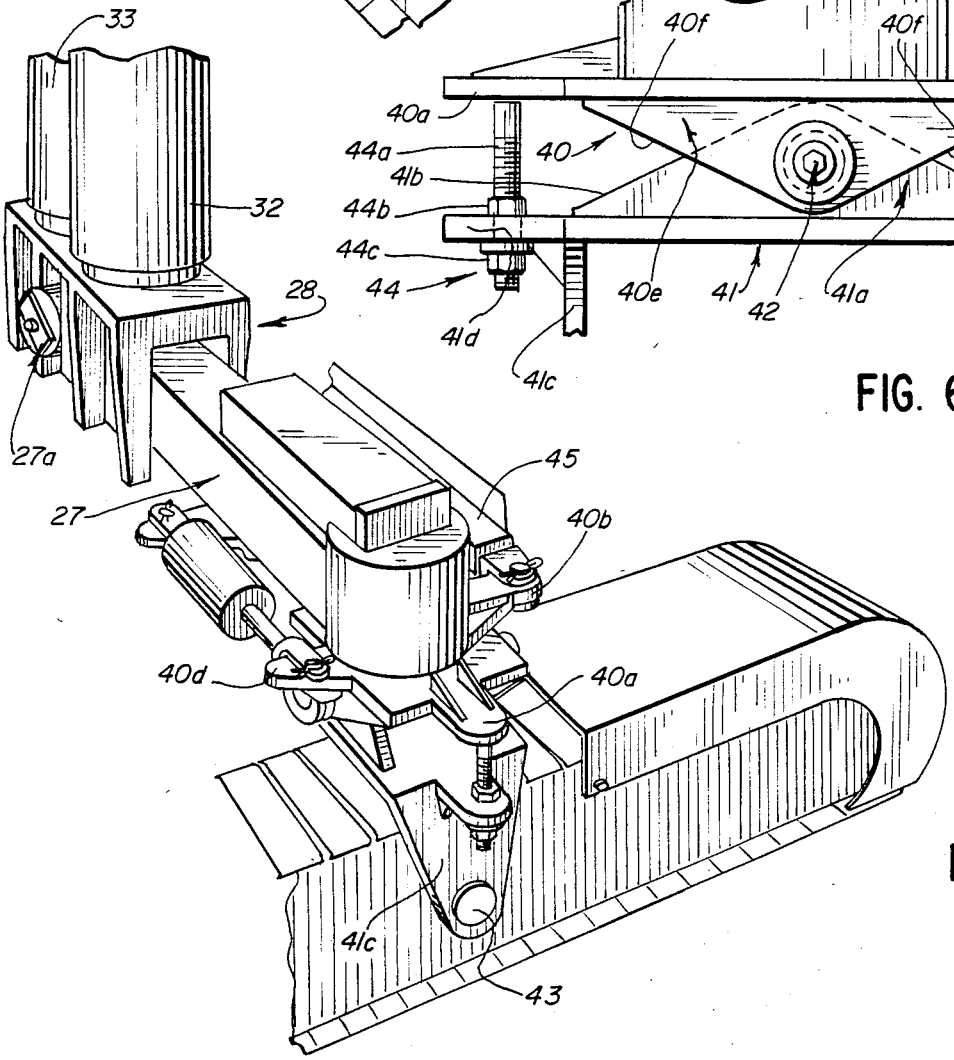
FIG. 5 is an enlarged fragmentary front perspective view of the track of FIG. 4 and showing a steering cylinder mounted thereon.

Upper section 40 is provided with a pair of depending platelike segments 40*e*, each of which has a pair of tapered opposed side edges 40*f*, see FIG. 6.

Embraced by and disposed between segments 40*e* is a pair of upwardly extending, spaced, parallel flanges 41*a* which form a part of a lower section 41 of saddle assembly 38. Side edges 41*b* of the flanges 41*a* are tapered in a manner similar to the tapered side edges 40*f* of depending segment 40*e*. Flanges 41*a* are pivotally connected to depending segments 40*e* by a suitable gudgeon 42 which extends through suitable aligned openings formed in the segments 40*e* and flanges 41*a*.

Depending from lower section 41 and offset at right angles with respect to the upwardly extending flanges 41*a* is a second pair of substantially parallel flanges 41*c*. The spacing between flanges 41*c* is such that the adjacent track will fit therebetween. The track at its midlength is journaled at 43 to the second pair of flanges 41*c*, see FIG. 3.

Lower section 41 is provided with a pair of diametrically opposed, laterally extending lugs 41*d* which are vertically aligned with lugs 40*a*, 40*c* formed on the upper section 40, see FIG. 6. Each lug 41*d* is provided with an adjustable nut-bolt assembly 44 which includes a transversely extending stud bolt 44*a* and pairs of nuts 44*b*, 44*c* threaded onto the lower end of the stud bolt and disposed on opposite sides of the lug 41*d*. Upon adjustment of the nuts on the stud bolt the upper end of the bolt will abut against the underside of the aligned lug 40*a*, 40*e* of the upper section 40 and retain the upper and lower sections 40, 41 in a selected position of pivotal adjustment. By proper tilt adjustment of the sections of each saddle assembly 38, the surfaces of the tracks in contact with the base surface B the tracks will conform substantially to the configuration of the base surface. Other means may be employed, if desired, to retain the sections 40, 41 in selected positions of pivotal adjustment.

It is normally desirable to have the rear set of tracks 25, 26 turn in unison with one another. To facilitate such movement, lugs 40*b* on the upper section 40 of each of the saddle assemblies 38 are interconnected by bar 45. The length of the bar is such that it maintains the tracks in substantially parallel relation regardless of the turning position of the tracks relative to the beam 27.

As aforementioned, the turning of tracks 23, 24, 25, 26 and the raising or lowering of the beam 27 and the saddle assemblies for front tracks 23, 24 may be automatically regulated through impulses generated by sensors 36, 37 sliding along the stringline SL as the machine moves along the base surface. If desired, however, such manipulations may be made manually through a plurality of controls C′ conveniently located on the main frame 21.

The main frame 21, as noted in FIGS. 1 and 2, includes a front section F and an elongated trailing section T, which is cantilevered rearwardly therefrom. Trailing section T in the illustrated embodiment, includes a pair of spaced, substantially parallel beams 46, the distal ends of which are interconnected by a cross member 46*a*.

Figure 11:
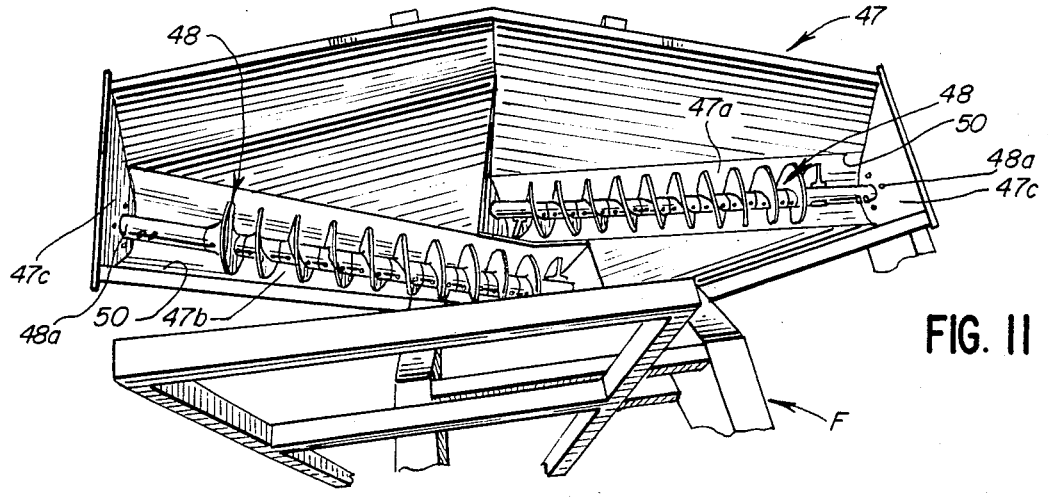
FIG. 11 is an enlarged fragmentary top perspective view of the first hopper.
Figure 12:
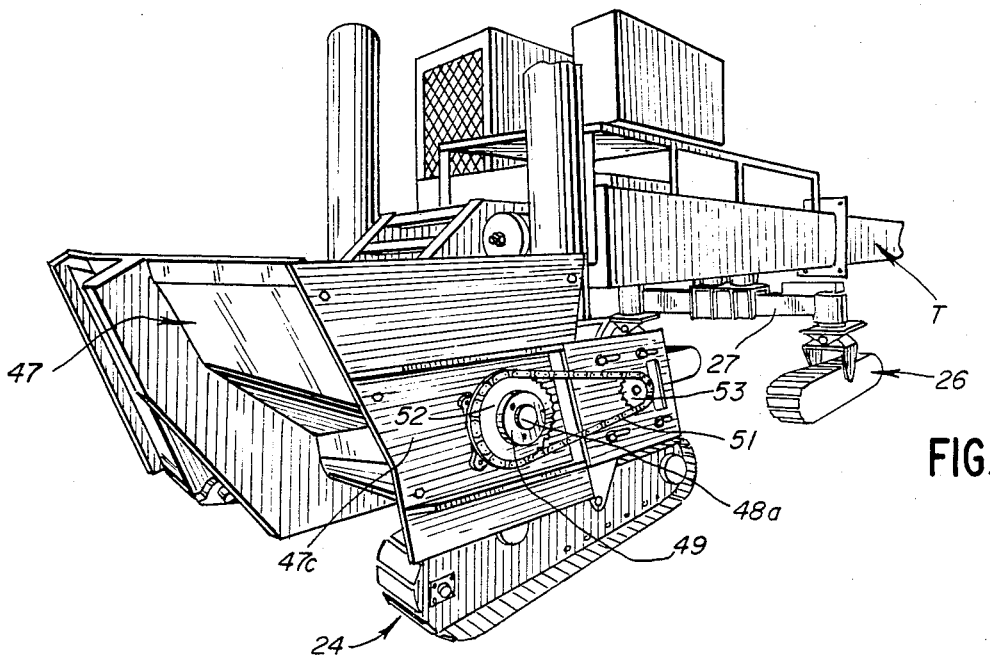
FIG. 12 is an enlarged fragmentary side front perspective view of the first hopper with a protective cover removed therefrom.

Mounted on and disposed forwardly of main frame 21 is a first hopper 47, see FIGS. 11–13, which is adapted to receive a load of formable concrete from a supply truck, which is positioned so as to precede the machine as the latter moves along the base surface. Where the construction project involves a tunnel or where no adjacent truck roadway paralleling the base surface is provided, the supply truck will move along the same base surface as that traveled by the machine 20.

Hopper 47 has an open top and downwardly sloping bottom sections 47*a*, 47*b*. The lowermost end limit of each bottom section is adjacent the transverse centerline X—X of the hopper. As noted in FIG. 11, bottom section 47*a* is offset forwardly of bottom section 47*b* thereby forming two contiguous compartments of substantially like configuration.

To provide effective removal of the formable concrete product from hopper 47, a driven auger-type conveyor 48 is disposed within each of the compartments, see FIG. 11. The upper end of each conveyor 48 projects over an opening 50 formed in the upper portion of the bottom section 47*a*, 47*b* thereby enabling the conveyed concrete to be discharged from the compartment by the force of gravity.

The upper end 48*a* of each conveyor 48 is supported by a bearing 49, see FIG. 12, mounted on the end wall 47*c* of the hopper. In the illustrated embodiment each conveyor 48 is chain driven from a suitable motor mounted adjacent the back side of hopper 47. A chain 51 is disposed externally of the hopper end wall 47*c* and coacts with a first sprocket 52, keyed to the exposed end of the conveyor shaft 48*a*, and a second sprocket 53 keyed to the motor drive shaft. A protective cover or hood 54 is removably mounted on the hopper end wall 47*c*.

Figure 8:
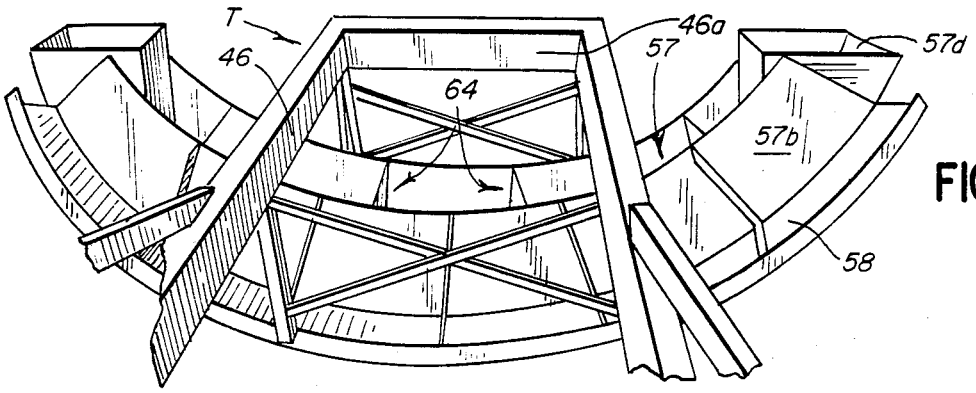
FIG. 8 is a fragmentary front perspective view of the second hopper forming a component of the mule.

Supported by and subtending the rear end portion of the frame trailing section T is a mule M, see FIG. 8, which includes a second hopper 57 having a curvilinear open bottom 57*a*, see FIG. 2. The configuration of the hopper bottom 57*a* conforms substantially to the configuration of the base surface B on which the formable concrete is to be laid. The hopper bottom 57*a* shown in FIG. 2, defines an arc of approximately 120°. Where the project involved is a tunnel, the remaining surfaces of the tunnel (e.g. curved upper side walls and curved top wall) may be covered with a layer of concrete by various methods such as spraying, etc. This latter method of applying the concrete forms no part of the invention herein disclosed and claimed.

Extending forwardly and rearwardly from the hopper bottom 57*a* and having a curvature corresponding to that of the hopper bottom are front and rear form plates 58, 60, respectively. Front plate 58 projects a relatively short distance forwardly from the front wall 57*b* of the hopper and functions primarily to prevent concrete flow forwardly of the hopper wall 57*b*. Rear plate 60, on the other hand, extends rearwardly a substantial distance from the hopper rear wall 57*c*. Rear plate 60 functions as a screed and form for the formable concrete discharged from the hopper bottom 57*a* onto the base surface as the machine moves therealong. As the rear plate 60 slides over the discharged concrete, it causes the layer of concrete to be of substantially uniform thickness, compactness, and appearance. Further finishing of the exposed layer of concrete may be manually undertaken, if desired, in various ways well known in the art.

As will be noted in FIGS. 1 and 2, the hopper 57 and the front and rear plates 58, 60, respectively, have a transverse, or lateral, dimension, which is greater than the lateral spacing between the front set of tracks 23, 24. It is by reason of this structural feature, that the improved machine 20 may be readily utilized in tunnel construction projects or the like.

Figure 9:
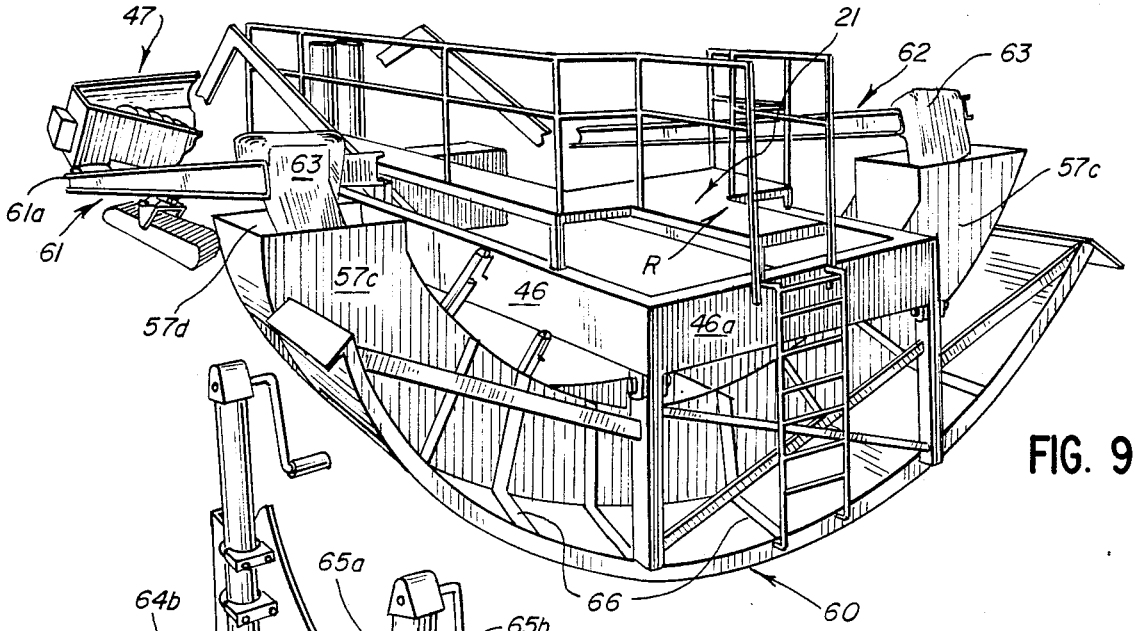
FIG. 9 is a fragmentary side rear perspective view of the second hopper and showing the discharge end of one of the side conveyors for transferring formable concrete from the first hopper to one end portion of the second hopper.

As noted in FIGS. 2 and 9, the formable concrete is transferred from the opposite ends of the front hopper 47 to the opposite, elevated ends 57*d* of the rear hopper 57 by a pair of belt-type conveyors 61, 62 which are mounted on opposite sides of main frame 21. The forward end 61*a*, 62*a* of each conveyor 61, 62 is disposed beneath the end openings 50 formed in the upper portion of the bottom sections 47*a*, 47*b* of the front hopper 47. The opposite or rear end 61*b*, 62*b* of each of the conveyors 61, 62 discharges the formable concrete into a flexible chute 63 which in turn directs the concrete into the adjacent upwardly facing open end 57*d* of hopper 57.

Figure 10:
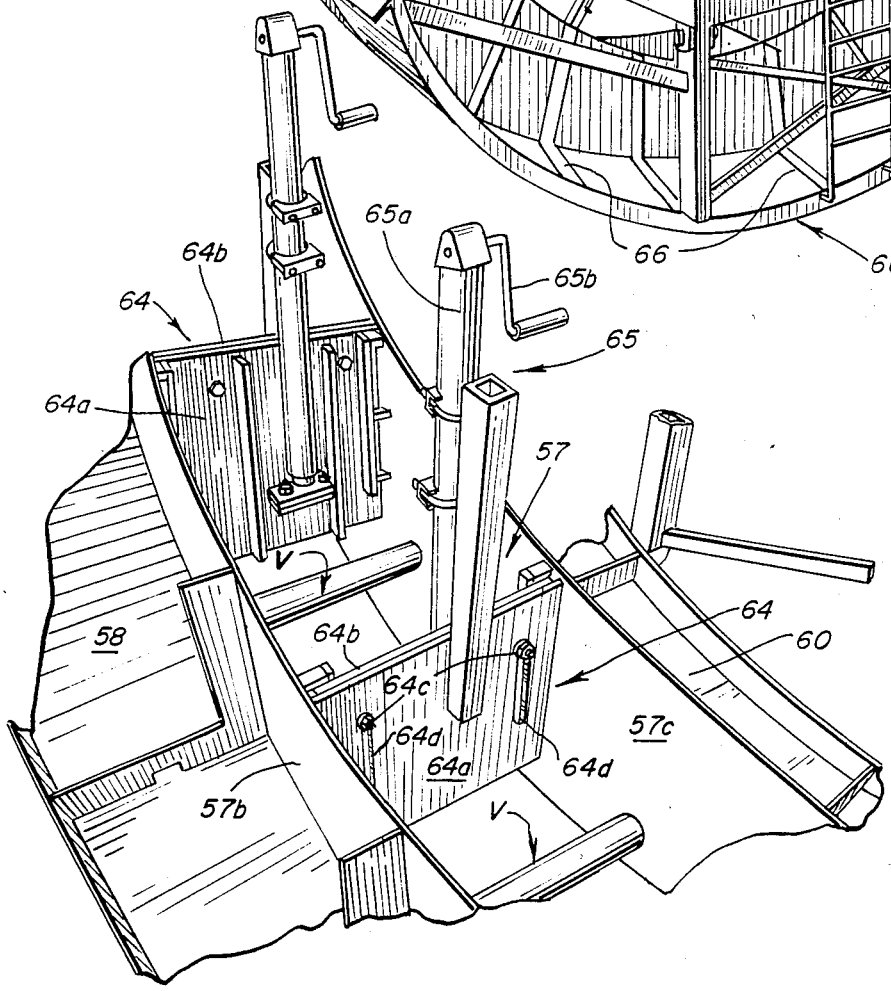
FIG. 10 is an enlarged fragmentary top perspective view of a portion of the second hopper showing adjustable flow-control baffle units mounted within the interior of the second hopper.

In order to prevent an excessive amount of the concrete, deposited into the hopper 57, from accumulating at the lowermost, central portion thereof and thus, cause uneven distribution of the concrete onto the base surface, a series of vertically adjustable baffle units 64 are positioned within the hopper interior, see FIG. 10. Each baffle unit includes a stationary web-like member 64*a* which spans the distance between the front and rear hopper walls 57*b*, 57*c*, respectively, and is disposed substantially normal thereto. Positioned to one side of member 64*a* and in sliding face-to-face relation therewith is a second plate-like member 64*b*. Member 64*b* is selectively movable relative to member 64*a* in a substantially vertical plane by a pawl and ratchet assembly 65 or some other suitable means.

The pawl is disposed within a tubular protuberance 65*a* which projects upwardly from member 64*b*. Rotation of the pawl is obtained by a hand crank 65*b*. Members 64*a*, 64*b* are retained in face-to-face relation by a plurality of assembly pins 64*c* carried by one of the members and having the shanks thereof slidably disposed within elongated vertically extending slots 64*d* provided on the other member. Thus, by varying the relative position of member 64*b*, the downward flow of the concrete toward the center of the hopper underside can be effectively controlled. The consistency and viscosity of the concrete and the slope or curvature of the base surface on which the concrete is to be laid will be important factors in determining the proper adjustment of the baffle member 64*b*.

To facilitate access to the hand crank 65*b*, a plurality of steps 66 may be provided on the exposed upper surface of the rear plate-like member 60.

In addition to the baffle units 64, aforedescribed, the rear hopper 57 is also provided with suitable vibrating devices V of conventional design, which are disposed between the baffle units and span the distance between the walls 57*b*, 57*c*. The devices V are immersed in the concrete deposited into the rear hopper. Suitable controls may be provided for varying the vibrating frequency of the devices in a manner well known in the industry.

Because the mule M is spaced rearwardly a substantial distance from the front section F of the main frame 21 and due to the fact that the trailing section T is cantilevered from the front section, there is provided substantial unobstructed work space W to allow reinforcing mesh or rods to be properly placed on the base surface ahead of the mule, but behind the tracks 25, 26 and thus, avoid said mesh or rods interfering with the tracks.

To facilitate movement of operating personnel from the frame front section to the mule M and vice versa, a suitable walkway or ramp R may be mounted on the upper portion of the main frame, see FIGS. 1 and 2.

While the mule M, as illustrated, is particularly suitable for laying concrete on a base surface having a circular ring sector configuration of approximately 120°, it is not intended to be limited thereto.

Thus, an improved, highly versatile construction machine has been provided which may readily operate in confined areas, such as tunnels or like; enables a truck moving ahead along the base surface to deposit its load into a front hopper provided on the machine without disrupting normal operation of the machine. The improved machine also provides a convenient space for laying reinforcing mesh or rods onto the base surface without interference from the tracks of the machine. Furthermore, the improved machine permits the main frame tracks to be adjusted so as to closely conform to the configuration of the portion of the base surface engaged thereby.

I claim:

1. A construction machine for use in the controlled distribution of formable concrete along an elongated transversely limited site having a base surface of a predetermined configuration and a predetermined lateral dimension, said machine comprising: a main frame for movement longitudinally along the base surface, said main frame including a front section and an elongated trailing section extending substantially rearwardly therefrom, said sections overlying the base surface on which the formable concrete is to be distributed; propelling means mounted beneath said main frame and adapted to be supportingly engaged by the base surface as said frame moves thereacross; a first hopper means mounted on said frame front section and overlying such base surface to receive a load of formable concrete from a source independent of and positioned forwardly of said machine on the base surface on which said concrete is to be distributed; an elongated mule mounted on said frame trailing section and extending laterally therefrom and being spaced a substantial distance rearwardly of said first hopper means and rearwardly of said propelling means, said mule overlying such base surface and including a second hopper means having an undersurface conforming substantially to the predetermined configuration of the base surface in supporting engagement with said propelling means; conveying means carried on said main frame and extending from said first hopper means to said second hopper means in a direction generally longitudinally of said construction machine for controlled rearward transfer of formable concrete from said first hopper means to said second hopper means; vibrating means operatively mounted on said second hopper means; and control means mounted on said main frame and operatively connected to said propelling means for controlling relative movement and steering of said machine along the base surface, whereby concrete delivered to such machine from a source on such base surface forward of said machine is placed on said base surface by said mule at the rear of said machine.

2. The machine of claim 1 wherein the base surface has a substantially concave configuration and the undersurface of said mule has a complementary convex configuration.

3. The machine of claim 2 wherein said second hopper means is provided with an elongated arcuate cavity the curvature of which is complemental to the curvature of the base surface.

4. The machine of claim 3 wherein the conveying means is adapted to transfer formable concrete from said first hopper means to opposite elevated ends of the elongated arcuate cavity of said second hopper means.

5. The machine of claim 4 wherein the arcuate cavity of the second hopper means is provided with means for controlling the downward flow of the formable concrete within said cavity.

6. The machine of claim 2 wherein the undersurface of said mule second hopper means defines an arc of substantially 120°.

7. The machine of claim 1 wherein said control means includes sensing means extending from said main frame and coacting with an elongated external guide extending in a predetermined direction relative to the base surface to effect movement of said machine along the base surface in substantially the direction of said guide.

8. The machine of claim 1 wherein the propelling means includes a pair of laterally spaced power driven tracks disposed beneath said main frame, each track being independently adjustable relative to said main frame to conform substantially to the configuration of the portion of the base surface engaged thereby, the movement of each track being controlled by said control means.

9. The machine of claim 8 wherein each of said tracks is substantially self-adjusting to the contour of the base surface engaged thereby.

10. The machine of claim 1 wherein an elevated walkway extends between said first and second hopper means.

11. The machine of claim 1 wherein the trailing section is disposed in substantially cantilever relation with respect to the front section of the main frame, and the mule substantially subtends the free end of said trailing section and is supported thereby.

12. The machine of claim 1, 6, or 11 wherein said mule is spaced from said frame front section and said propelling means to provide workspace therebetween for placement adjacent said base surface, rearwardly of said propelling means and forwardly of said mule, of components to be embedded in the concrete placed by said mule.

13. The machine of claim 1 wherein said first hopper means includes an auxiliary conveyor unit for directing the concrete accumulated therein towards an adjacent end of the conveying means.

14. The machine of claim 13 wherein said first hopper means is provided with a downwardly tapered bottom surface; the interior of said first hopper means being formed into a pair of contiguous compartments, each compartment being provided with an auxiliary conveyor means.

15. The machine of claim 1 wherein the width dimension of the undersurface of the second hopper means is greater than the lateral dimension of the propelling means, both of said dimensions being measured transversely of the direction of movement of the machine along the base surface.

16. An apparatus for placing formable concrete on an elongated base surface, said apparatus comprising: a movable main frame for movement along such a surface in overlying relation thereto; propelling means mounted beneath said main frame and adapted to be supportingly engaged by the base surface as the said frame moves over said base surface; a mule spaced a substantial distance rearward of the rear distal end of said main frame for overlying said base surface and having a hopper with an undersurface conforming substantially to the predetermined configuration of the base surface; support means spaced laterally of said main frame and fixed to said main frame for cantilevered support of said mule in such substantially rearwardly spaced position, and for providing substantial workspace for placement of reinforcing materials on the base surface between said main frame and said mule, said mule subtending said support member; and conveying means carried on said support member for controlled rearward transfer of concrete from said main frame to the hopper of said mule.

17. Apparatus as in claim 16 further comprising vibrating means operatively mounted on said hopper of said mule for compacting the concrete.

18. The apparatus of claim 17 wherein the base surface has a substantially concave configuration and the undersurface of said mule has a complementary convex configuration.

19. The apparatus of claim 18 wherein said hopper of said mule is provided with an elongated arcuate cavity the curvature of which is complemental to the curvature of the base surface.

20. The apparatus of claim 19 wherein the conveying means is adapted to transfer formable concrete from said main frame to opposite elevated ends of the elongated arcuate cavity of said hopper.

21. The apparatus of claim 20 wherein the arcuate cavity of the hopper is provided with adjustable means for controlling the downward flow of the formable concrete within said cavity.

* * * * *